US010309174B2

(12) United States Patent
Burgos et al.

(10) Patent No.: US 10,309,174 B2
(45) Date of Patent: Jun. 4, 2019

(54) AUTOMATED REMOTE ACTUATION SYSTEM

(71) Applicant: Schlumberger Technology Corporation, Sugar Land, TX (US)

(72) Inventors: Rex Burgos, Richmond, TX (US); Douglas A. Pipchuk, Calgary (CA); Larry J. Leising, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 315 days.

(21) Appl. No.: 14/408,273

(22) PCT Filed: Jun. 6, 2013

(86) PCT No.: PCT/US2013/044512

§ 371 (c)(1),
(2) Date: Dec. 15, 2014

(87) PCT Pub. No.: WO2014/004022

PCT Pub. Date: Jan. 3, 2014

(65) Prior Publication Data

US 2015/0136425 A1 May 21, 2015

Related U.S. Application Data

(60) Provisional application No. 61/665,515, filed on Jun. 28, 2012.

(51) Int. Cl.
*E21B 23/00* (2006.01)
*E21B 23/08* (2006.01)
(Continued)

(52) U.S. Cl.
CPC ..... *E21B 23/00* (2013.01); *E21B 23/08* (2013.01); *E21B 23/10* (2013.01); *E21B 34/14* (2013.01); *E21B 41/00* (2013.01)

(58) Field of Classification Search
CPC ..... E21B 23/00; E21B 23/08; E21B 23/10; E21B 34/14; E21B 43/12
(Continued)

(56) References Cited

U.S. PATENT DOCUMENTS 4,566,534 A * 1/1986 Going, III ..... E21B 34/066 166/66.7
6,041,857 A 3/2000 Carmody et al.
(Continued)

FOREIGN PATENT DOCUMENTS

| | | | |
|---|---|---|---|
| GB | 2405164 | A | 2/2005 |
| RU | 2335630 | C2 | 10/2008 |
| WO | 2014004022 | A1 | 1/2014 |

OTHER PUBLICATIONS

Examination Report issued in GCC Patent Application No. GC 2013-24751 dated May 26, 2016; 4 pages.

*Primary Examiner* — Cathleen R Hutchins

(57) ABSTRACT

A technique provides an actuation system employed to actuate a tool, such as a downhole tool. The tool is actuated by an actuator element, e.g. a ball, which is selectively releasable from a remote location for interaction with the tool. A carrier is used to hold the actuator element at the remote location until its desired release for interaction with the tool. The carrier may comprise an electro-mechanical actuator mechanism positioned to control release of the actuator element upon receipt of an appropriate control signal.

20 Claims, 3 Drawing Sheets

(51) Int. Cl.
*E21B 23/10* (2006.01)
*E21B 34/14* (2006.01)
*E21B 41/00* (2006.01)

(58) Field of Classification Search
USPC ..... 166/318, 193
See application file for complete search history.

(56) References Cited

U.S. PATENT DOCUMENTS

| | | | | |
|---|---|---|---|---|
| 6,220,360 | B1 | 4/2001 | Connell et al. | |
| 6,959,766 | B2 | 11/2005 | Connell | |
| 2004/0020643 | A1* | 2/2004 | Thomeer | E21B 47/01 166/250.01 |
| 2004/0055753 | A1* | 3/2004 | Davis | E21B 21/10 166/318 |
| 2004/0134667 | A1 | 7/2004 | Brewer et al. | |
| 2005/0039925 | A1 | 2/2005 | Connell | |
| 2011/0147086 | A1 | 6/2011 | Hummes et al. | |
| 2012/0037360 | A1* | 2/2012 | Arizmendi, Jr. | E21B 23/04 166/250.01 |
| 2013/0175053 | A1* | 7/2013 | Madero | E21B 33/12 166/387 |

* cited by examiner

AUTOMATED REMOTE ACTUATION SYSTEM

BACKGROUND

Many tools deployed on coiled tubing for carrying out well interventions are designed to be ball activated. These tools are conveyed into a wellbore at the end of coiled tubing and are later activated while in the well. A ball of a predetermined size is placed inside the coiled tubing at a surface location and pumped down to the tool location via fluid flow. Once seated in place at the tool, circulation through the tool is interrupted. Additional pumping of fluid causes pressure above the ball to rise until sufficient force is created to activate the tool. The success of the process depends on the ability to place the ball properly downhole. However, proper placement of the ball can be compromised when cable is present inside the coiled tubing or when a large diameter pipe is used. Additionally, components above the ball-activated tool are often sized to allow free passage of the ball. Attempts have been made to release the ball from other locations, but such attempts have tended to rely on fluid flow which has limited adaptability for a variety of applications.

SUMMARY

In general, the present disclosure provides an actuation system used to actuate a tool, such as a downhole tool. The tool is actuated by an actuator element, e.g. a ball, which is selectively releasable from a remote location for interaction with the tool. A carrier is employed to hold the actuator element at the remote location until its desired release for interaction with the tool. The carrier may comprise an electro-mechanical actuator mechanism positioned to control release of the actuator element upon receipt of an appropriate control signal.

BRIEF DESCRIPTION OF THE DRAWINGS

Certain embodiments will hereafter be described with reference to the accompanying drawings, wherein like reference numerals denote like elements. It should be understood, however, that the accompanying figures illustrate only the various implementations described herein and are not meant to limit the scope of various technologies described herein, and.

DETAILED DESCRIPTION

In the following description, numerous details are set forth to provide an understanding of some illustrative embodiments of the present disclosure. However, it will be understood by those of ordinary skill in the art that the system and/or methodology may be practiced without these details and that numerous variations or modifications from the described embodiments may be possible.

The disclosure herein generally relates to a system and methodology which enable remote actuation of tools. In well environments, for example, a downhole tool may be actuated by the remotely controlled release of an actuator element which drops via gravity and/or flows downstream to the tool to enable actuation of the tool. According to one embodiment, the actuator element is a ball selectively releasable from a downhole location for interaction with the tool. A carrier may be employed to hold the actuator element at the remote location until the tool is to be actuated. The carrier may comprise an electro-mechanical actuator mechanism which is operated via control signals sent from a remote, e.g. surface, location to control release of the actuator element. Once released, the actuator element moves downstream to the actuatable tool and lands in a corresponding seat. Application of pressure and the consequent creation of a pressure differential across the actuator element cause actuation of the tool.

The actuation system is configured such that there is no need to release a ball from the surface and to then pump it down along the wellbore to activate a tool. In some downhole applications the actuator system comprises a carrier with a single ball and in other applications the actuator system uses a plurality of balls or other actuator elements. The plurality of actuator elements may be released simultaneously or they may be individually released in a controlled manner. Release of the plurality of actuator elements is similarly controlled remotely from, for example, a surface location to enable movement of the actuator elements into engagement with corresponding downhole tools. In some applications, release of the ball or other type of actuator element is remotely controlled from the surface using a fixed signaling platform.

Figure 1:
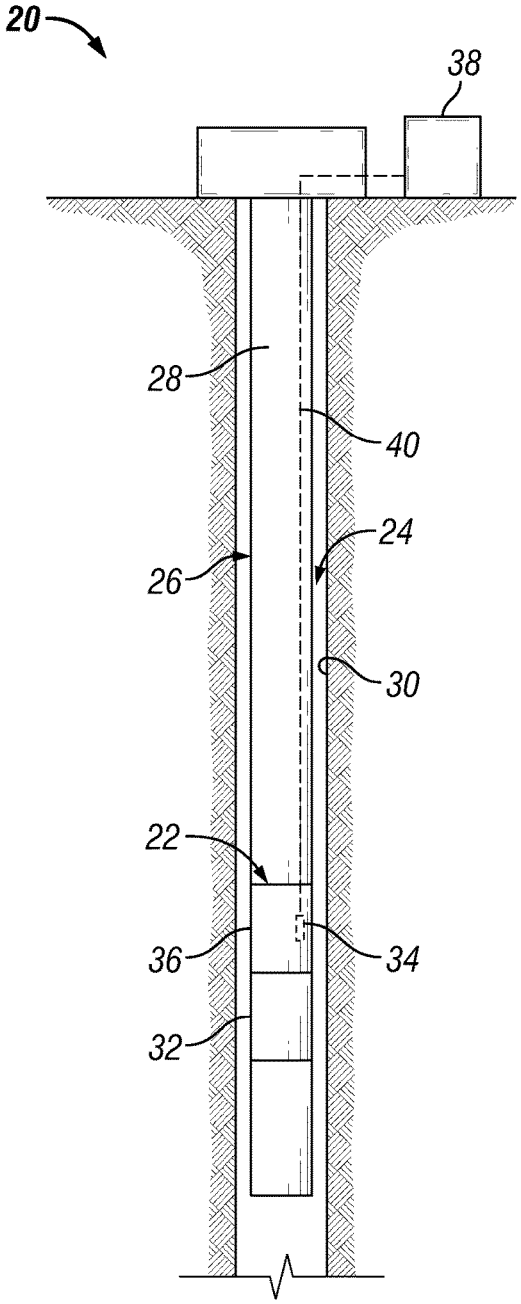
FIG. 1 is a schematic illustration of an example of a well system comprising a tool and an actuation system for the tool, according to an embodiment of the disclosure.

Referring generally to FIG. 1, an example of one type of application utilizing an actuation system combined with an actuatable tool is illustrated. The example is provided to facilitate explanation, and it should be understood that a variety of tools may utilize the actuation systems described herein. In many applications, the actuatable tools comprise downhole well tools although the actuation system may be used with other types of tools in other environments.

In FIG. 1, an embodiment of a well system 20 is illustrated as comprising downhole equipment 22, e.g. a bottom hole assembly, deployed in a wellbore 24 on a tool string 26. The bottom hole assembly 22 may be deployed downhole via a conveyance 28, e.g. coiled tubing, forming part of tool string 26. The bottom hole assembly 22 may include a wide variety of components, depending in part on the specific application, geological characteristics, and well type. In the example illustrated, the wellbore 24 is substantially vertical and lined with a casing 30. Various bottom hole assemblies, well completions, and other embodiments of downhole equipment 22 may be used in a well system having many types of wellbores, including deviated, e.g. horizontal, single bore, multilateral, single zone, multi-zone, cased, uncased (open bore), or other types of wellbores.

In the example illustrated, bottom hole assembly 22 comprises an actuatable tool 32, such as a valve, which may be actuated between different operational positions with the aid of an actuator element 34 selectively released from an actuation system 36. By way of example, actuator element 34 may comprise a ball and actuation system 36 may comprise a ball drop system. The release of actuator element 34 is controlled from a remote location, such as a surface location, by a control system 38. In some applications, the control system 38 comprises a fixed signaling platform. When tool 32 is to be actuated, the actuator element 34 is released by actuation system 36 upon receipt of an appropriate control signal from control system 38 via a communication line 40.

Communication line 40 may comprise a variety of control lines capable of carrying control signals. For example, communication line 40 may comprise an optical fiber and/or an electrical conductor, e.g. a wire, routed downhole along tool string 26. In some applications, the communication line 40 is disposed within coiled tubing 28, e.g. within an interior of the coiled tubing such as a fiber optic tether comprising an outer protective tube encasing on or more optical fibers or the like, or within a wall of the coiled tubing. In other applications, the communication line 40 may be a wireless communication line by which wireless communication signals, e.g. electromagnetic, such as via WiMax communication, or acoustic signals, such as pulse communication or the like, are transmitted downhole via control system 38.

Tool 32 and actuation system 36 may be used in a variety of well and non-well related applications in which the tools are positioned and actuated along a fluid flow path. In well applications, tool 32 may be designed for use in intervention operations and other well based operations. For example, tool 32 or a plurality of tools 32 can be used as active enablers for performing well remediation operations or to provide a contingency function upon the occurrence of an unplanned event or situation. The tool or tools 32 often are conveyed downhole in a dormant or passive state, and actuation system 36 is used to selectively actuate the desired tool 32 when, for example, a target depth is reached or when a certain condition occurs. Examples of tools 32 include disconnect tools, release joints, circulation valves, perforating firing heads, and other tools which may be actuated downhole. The tool 32 may comprise a tool permanently installed in the wellbore 24, such as, but not limited to, an intelligent completion device such as a sand control screen or the like.

In a variety of applications, the actuator element 34 is selectively released from a location proximate tool 32 so the actuator element 34 is easily able to move into engagement with the tool 32. The actuator element 34 also may comprise a ball or other element having a surface designed to readily engage a corresponding seat in tool 32. Placement of the actuator element 34 across a corresponding sealing surface bridges the internal flow area of the tool and effectively arrests fluid circulation. Additional pumping of fluid down through tool string 26 creates a pressure differential across the actuator element 34 until sufficient force is created to actuate tool 32. The force can be used to shift a variety of activating mechanisms within tool 32 depending on the type and design of the downhole tool.

Figure 2:
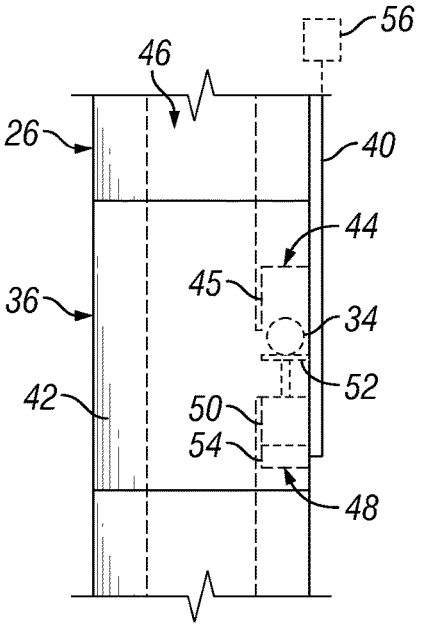
FIG. 2 is a schematic illustration of an example of the actuation system, according to an embodiment of the disclosure.

Referring generally to FIG. 2, a schematic representation of an example of actuation system 36 and actuator element 34 is illustrated. It should be noted, however, the actuation system 36 and the actuator element 34 may be constructed in a variety of forms and configurations utilizing many types of carrier components, release components, actuator components, and other components selected according to the parameters of a given operation. In the example illustrated, actuation system 36 comprises an actuator housing 42 having a carrier 44 designed to carry an actuator element 34, such as a ball, in an internal containment structure 45. The actuator housing 42 also comprises a primary flow passage 46 which is part of the overall flow passage in tool string 26 which allows down flow of, for example, injection fluids and/or up flow of fluids, such as production fluids.

In the example illustrated, carrier 44 further comprises an electro-mechanical actuator mechanism 48. The release of actuator element 34 from carrier 44 is controlled by electro-mechanical actuator mechanism 48. According to one embodiment, the electro-mechanical actuator mechanism 48 comprises a solenoid 50 coupled to a release gate 52 which may be selectively moved to release the actuator element 34. Release of the actuator element 34 allows the actuator element 34 to move into flow passage 46 and to flow downstream and into engagement with the corresponding tool 32. Movement of the release gate 52 to the release position via solenoid 50 (or other suitable electro-mechanical actuator mechanism) is controlled remotely via control system 38 and control signals provided via communication line 40. In this example, the actuator element 34 is released directly through actuation of the electro-mechanical actuation mechanism 48 at a location proximate tool 32.

Electrical power may be provided to electromechanical actuator mechanism 48 via a suitable power source. For example, a downhole battery 54 may be used to supply power from a downhole location. In some applications, the battery 54 is a rechargeable battery which may be recharged by energy provided through communication line 40. In other applications, a remote power source 56 may be used alone or in combination with battery 54 to supply power to the electro-mechanical actuator mechanism 48. By way of example, the remote power source 56 may be located at the surface.

Figure 3:
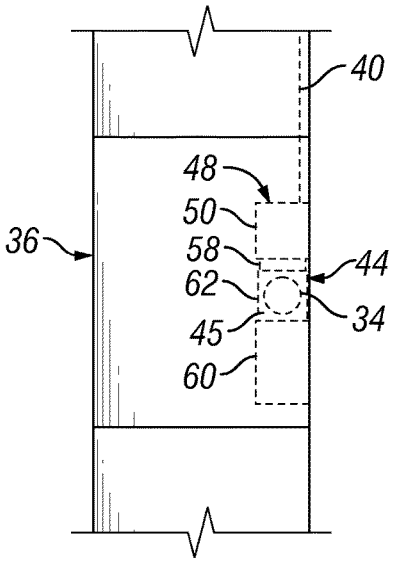
FIG. 3 is a schematic illustration of another example of the actuation system, according to an alternate embodiment of the disclosure.

Referring generally to FIG. 3, another example of actuation system 36 is illustrated. In this embodiment, electro-mechanical actuation mechanism 48 is used to release a locking mechanism 58 which then enables release of the actuator element 34 via a secondary input. For example, electro-mechanical actuator mechanism 48 may again comprise a solenoid 50 coupled to locking mechanism 58 to enable removal/release of locking mechanism 58 upon receipt of an appropriate control signal via communication line 40. The secondary input may be applied to a primary actuator 60 which is coupled to an actuator element release mechanism 62, e.g. a ball release mechanism.

By way of example, primary actuator 60 may be actuated via fluid flow along flow passage 46. Thus, once solenoid 50 is actuated to release locking mechanism 58, a predetermined fluid flow may be pumped down through flow passage 46 to shift primary actuator 60, thus removing release mechanism 62 from its position blocking release of actuator element 34. In a specific example, fluid flow may be used to create a differential pressure across an orifice area to trigger release of the actuator element/ball 34. The locking mechanism 58 prevents release of the ball 34 despite the presence of the differential pressure until the locking mechanism 58 is disabled or otherwise actuated by mechanism 48 to permit release of the ball 34. In this manner, the inadvertent release of ball 34 due to fluid flow and/or differential pressure sensitivity is avoided. However, the use of fluid flow as the secondary input is provided only as an example. The primary actuator 60 may be designed for actuation upon other types of secondary inputs, e.g. input via a hydraulic control line, input via an electrical control line, input via a pressure signature, or inputs via other sources and techniques.

Figure 4:
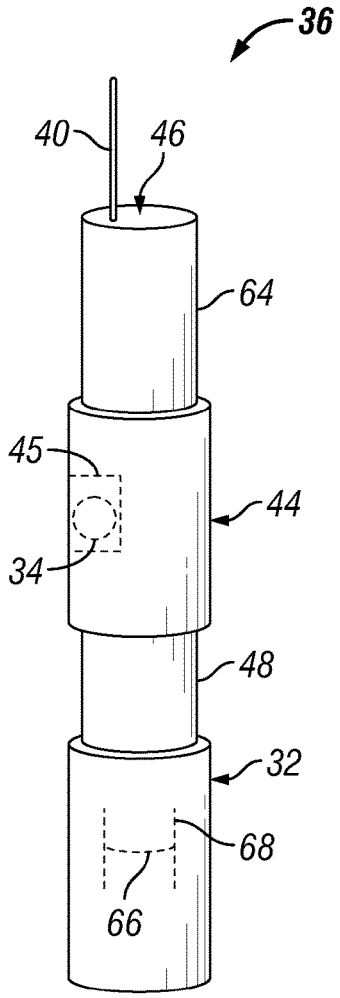
FIG. 4 is an illustration of an example of an actuatable tool combined with an actuation system, according to an embodiment of the disclosure.

In well applications, the tool 32 and actuation system 36 are designed for deployment along wellbore 24 and are often tubular in form. In FIG. 4, an example of an arrangement of actuation system 36 and tool 32 is illustrated for use in a wellbore environment. In this example, the system components are generally tubular and comprise carrier 44 in the form of a ball carrier for carrying at least one ball 34. Carrier 44 includes carrier structure 45 positioned between electro-mechanical actuation mechanism 48 and a receiver/controller 64. The receiver/controller 64 is coupled to communication line 40 and is designed to receive and process control signals to instigate actuation of electro-mechanical actuator mechanism 48 upon receipt of the appropriate control signal. Upon actuation of mechanism 48, ball 34 is either directly released or ready for release after the actuation system 36 receives an appropriate secondary input. When the ball 34 is released, the ball travels downstream to downhole tool 32 and engages a seat 66 of a shiftable component 68 within tool 32. Fluid may then be pumped down through flow passage 46 to create a pressure differential across the ball 34 until shiftable component 68 is moved and tool 32 is transitioned to a different operational configuration. It should be noted that a variety of other compatible well string components may be connected above and below the actuation system 36.

Figure 5:
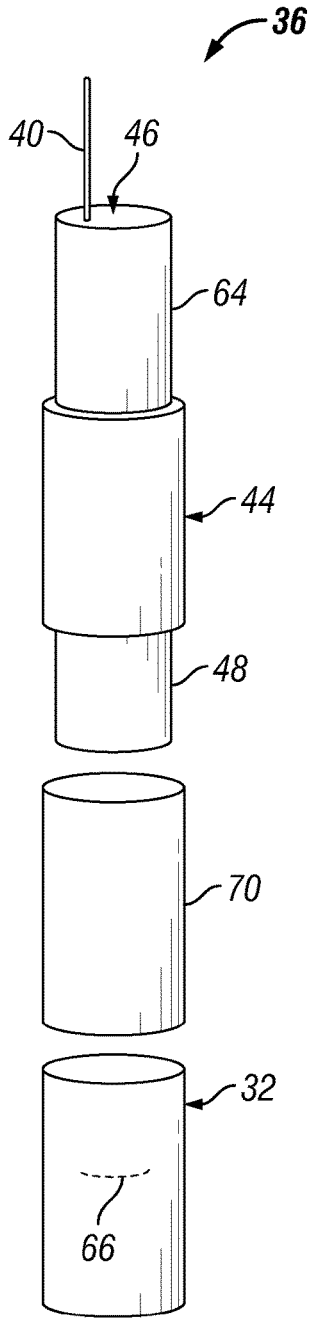
FIG. 5 is an illustration similar to FIG. 4 but showing another example of the tool and actuator system, according to an alternate embodiment of the disclosure.

Referring generally to FIG. 5, a similar embodiment is illustrated. In this latter embodiment, however, the ball seat 66 is at a lower section of the tool string 26 and is not located immediately below the electro-mechanical actuator mechanism 48, e.g. ball release mechanism. One or more additional tools or other components 70 may be positioned in the tool string between the ball release mechanism 45, 48 and the actuatable tool 32. In this example, the internal diameters of each of the components 70 below carrier 44 and above the ball seat 66 are dimensioned to enable free passage of the ball or other type of actuator element 34.

The embodiments illustrated in FIGS. 4 and 5 are designed so that actuation system 36 can be made up to bottom hole assembly 22 above the tool 32. In this example, the actuator element 34 remains in the retained position within carrier 44 during conveyance into wellbore 24. When release of the actuator element 34 is desired, a control signal is sent downhole from the surface via communication line 40 which may be in the form of a wire or an optic fiber line inside the coiled tubing 28. The actual release of actuator element 34 is achieved using solenoid 50 or another form of the electro-mechanical actuator 48. As discussed above, the electro-mechanical actuator mechanism 48 can be powered from the surface and/or from a downhole battery.

Once released, the actuator element 34 may fall by gravity and land on seat 66 immediately below (or a short distance from) the carrier 44 and actuation system 36. Fluid circulation through the bottom hole assembly 22 also may be used alone or in combination with gravity to cause the actuator element 34 to position correctly on seat 66. Fluid flow can be helpful when wellbore 24 is drilled as a deviated, e.g. lateral, wellbore. Once the actuator element 34 is properly positioned, fluid circulation is stopped and differential pressure builds until the desired force is created to actuate tool 32. The volume of fluid used to move actuator element 34 into position on seat 66 and to actuate tool 32 is relatively small because the distance over which the actuator element 34 is moved from its release point to tool 32 is relatively short.

Figure 6:
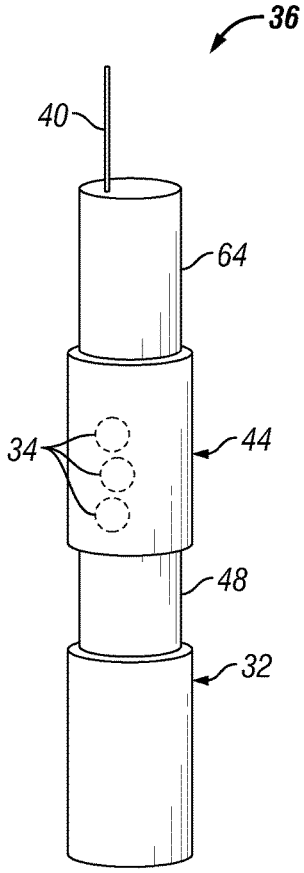
FIG. 6 is an illustration of another example of the tool and actuator system, according to an alternate embodiment of the disclosure.
Figure 7:
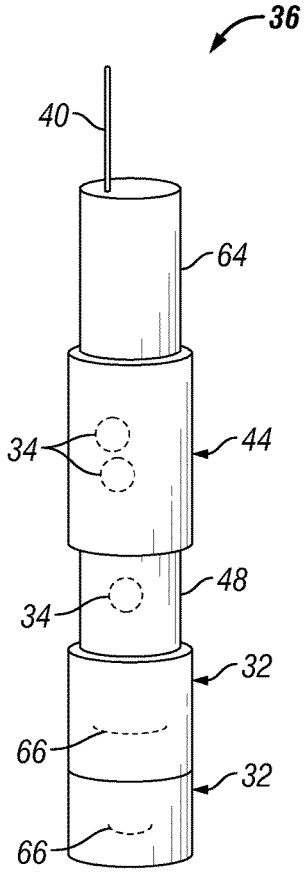
FIG. 7 is an illustration similar to FIG. 6 but showing the system in a different state of actuation, according to an embodiment of the disclosure.
Figure 8:
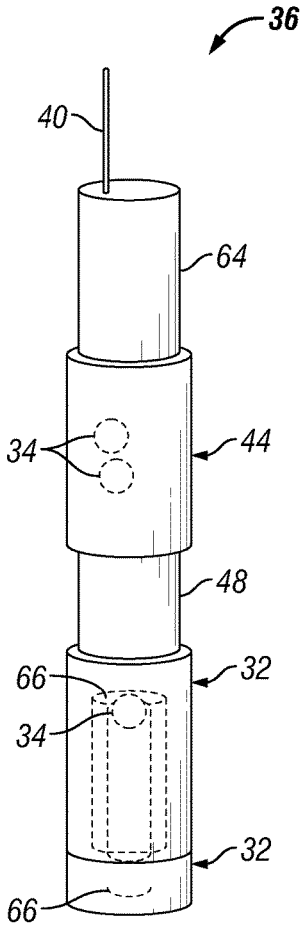
FIG. 8 is an illustration similar to FIG. 6 but showing the system in another state of actuation, according to an embodiment of the disclosure.

Referring generally to FIGS. 6-8, another embodiment of the actuation system 36 and tool 32 is illustrated. In this embodiment, the actuation system 36 and its carrier 44 are sized to hold a plurality of actuator elements 34, e.g. balls, as illustrated in FIG. 6. In some embodiments, the balls or other types of actuator elements 34 may be of the same size and may be released at the same time to activate a multi-ball activated tool 32. In other applications, the actuator elements 34 may have progressively larger diameters and may be sequentially stacked in carrier 44 according to the progressively larger diameters to enable activation of a plurality of sequentially positioned tools 32 in the bottom hole assembly 22. The actuator elements 34 are released by electro-mechanical actuator mechanism 48 individually, as illustrated in FIG. 7.

Each tool 32 of the plurality of sequentially positioned tools 32 comprises a shiftable component with a uniquely sized seat 66. In some applications, the lowermost tool 32 uses the smallest diameter seat and the uppermost tool 32 uses the largest diameter seat to enable sequential actuation of the plurality of tools 32. The initial actuator element 34 released from actuation system 36 may have a diameter selected to allow the actuator element to pass through the upper tools 32 (see FIG. 8) and to sealingly engage the lowermost seat 66. This enables actuation of the first tool 32 without affecting the other actuatable tools 32 positioned along the bottom hole assembly 22.

When it is desired to actuate the next sequential tool, an appropriate control signal is again sent to electro-mechanical actuator mechanism 48 to again open the release gate 52 so as to release the next sequential actuator element 34. This actuator element 34 then travels to the next sequential tool 32 and engages the corresponding seat 66. Once the actuator element 34 is sealed against the corresponding seat 66, the next sequential tool 32 may be actuated as described above. This process may be repeated for each of the actuator elements 34 and for each of the corresponding sequential tools 32.

The specific configuration of tool or tools 32 may vary depending on the design of the overall tool string and on the parameters of a given application. Additionally, the actuation system 36 may have a variety of components arranged in several different types of configurations. The actuator element may comprise a ball element or another suitable actuator element, such as a dart. The electro-mechanical actuator mechanism also may have a variety of configurations, including various types of solenoids. However, the electro-mechanical actuator mechanism may comprise ball screws, linear motors, and other types of electro-mechanical actuators. Similarly, the electro-mechanical actuator mechanism may utilize many alternate types of release gates which may include platforms, cages, rods, ratchet mechanisms, pivot mechanisms, sliding mechanisms, and other types of mechanisms designed to accommodate release of actuator elements of various styles and sizes.

The actuation system and corresponding tool(s) may be used in many well related applications, such as well interventions. However, the remotely released actuator element also may be employed to release desired actuator elements in a variety of other well related applications. Similarly, the actuation system may be employed to selectively and remotely actuate tools in non-well applications, e.g. in surface pipeline applications or other applications in which tools are located downstream along a pipeline or conduit and actuated from a remote location.

The actuation system and corresponding tool(s) may comprise and/or provide two-way feedback communication (such as along the communication line 40) from various sensors on bottomhole assembly 22 and/or the downhole tool 32 including, but not limited to, pressure, temperature, vibration, sensors or the like, for providing real-time indication of downhole conditions to an operator of the well system 20, as will be appreciated by those skilled in the art.

Although only a few embodiments of the system and methodology have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a downhole tool actuated by an actuator element;

a downhole carrier to carry a plurality of the actuator elements from a well surface to a position in the well, the downhole carrier comprising an electro-mechanical actuator mechanism selectively operable, from the well surface, to control release of each actuator element, at least one of the actuator elements being provided for actuation of the downhole tool; and coiled tubing to convey the downhole carrier into the well; and a control line routed along a flow path of the coiled tubing from a surface location to the downhole carrier to control operation of the electro-mechanical actuator mechanism.

2. The system as recited in claim 1, wherein the actuator element comprises a ball.

3. The system as recited in claim 1, further comprising a power source coupled to the electro-mechanical actuator mechanism, the power source being at a surface location.

4. The system as recited in claim 1, further comprising a power source coupled to the electro-mechanical actuator mechanism, the power source comprising a downhole battery.

5. The system as recited in claim 1, wherein the electro-mechanical actuator mechanism releases the actuator element directly.

6. The system as recited in claim 1, wherein the electro-mechanical actuator mechanism releases a locking mechanism to enable release of the actuator element upon a second input.

7. The system as recited in claim 1, wherein the downhole tool comprises one of a tool that is coupled to the downhole carrier and a tool permanently installed in the wellbore.

8. A method for use in a well, comprising:

coupling a ball actuatable tool into a tool string;

positioning a ball carrier in the tool string;

positioning a ball in the ball carrier;

delivering the tool string, the ball actuatable tool, the ball, and the ball carrier downhole into a wellbore;

sending a control signal downhole, via a communication line deployed in a flow path of the tool string, to a receiver/controller of the ball carrier;

based on the control signal, enabling an electro-mechanical device to release a ball from the ball carrier; and providing a secondary input to the ball carrier to cause release of the ball from the ball carrier.

9. The method as recited in claim 8, wherein actuating comprises actuating a solenoid.

10. The method as recited in claim 8, wherein sending comprises sending the control signal via an optical fiber.

11. The method as recited in claim 8, wherein sending comprises sending the control signal via an electrical conductor.

12. The method as recited in claim 8, further comprising using the ball to actuate the ball actuatable tool.

13. The method as recited in claim 8, further comprising selectively releasing a plurality of balls to actuate a plurality of ball actuatable tools.

14. The method as recited in claim 8, wherein the tool string comprises coiled tubing.

15. The method as recited in claim 8, further comprising performing at least one intervention operation with the tool string in the wellbore.

16. The method as recited in claim 8, wherein the ball actuatable tool comprises at least one of a disconnect tools, a release joint, a circulation valve, a perforating firing head, or combinations thereof.

17. A system, comprising:

a carrier that is part of a bottom hole assembly deployable, via a coiled tubing, in a wellbore, the carrier being sized to carry a plurality of actuator elements which are releasable to actuate at least one downstream tool, the carrier comprising an electro-mechanical actuator mechanism positioned to control release of at least one of the actuator elements from the carrier upon receipt of a control signal from the wellbore surface, the release of the actuator elements controlled by control signals sent along a control line disposed in a flow path of the coiled tubing.

18. The system as recited in claim 17, wherein the at least one actuator element comprises a ball.

19. The system as recited in claim 18, wherein the electro-mechanical actuator mechanism comprises a solenoid.

20. The system as recited in claim 17, wherein the downstream tool comprises one of a tool that forms part of the bottomhole assembly and a tool permanently installed in the wellbore.

* * * * *